US006623026B2

(12) United States Patent
Dogat et al.

(10) Patent No.: US 6,623,026 B2
(45) Date of Patent: Sep. 23, 2003

(54) SUPPORT DEVICE FOR A SKI BOOT

(75) Inventors: Vincent Dogat, Nevers (FR); Christian Lucas, Nevers (FR)

(73) Assignee: Look Fixations S.A., Nevers (FR)

( * ) Notice: Subject to any disclaimer, the term of this patent is extended or adjusted under 35 U.S.C. 154(b) by 115 days.

(21) Appl. No.: 10/059,954

(22) Filed: Nov. 21, 2001

(65) Prior Publication Data

US 2002/0084625 A1 Jul. 4, 2002

(30) Foreign Application Priority Data

Nov. 22, 2000 (FR) ..... 00 15055

(51) Int. Cl.[7] ..... A63C 5/00
(52) U.S. Cl. ..... 280/607; 280/629; 280/636
(58) Field of Search ..... 280/600, 601, 280/607, 611, 613, 617, 618, 616, 623, 625, 626, 628, 629, 633, 634, 636

(56) References Cited

U.S. PATENT DOCUMENTS

| | | | | |
|---|---|---|---|---|
| 4,088,345 A | | 5/1978 | Korger | |
| 4,398,747 A | * | 8/1983 | Bernard et al. | 280/634 |
| 4,911,464 A | * | 3/1990 | Gallet et al. | 280/636 |
| 4,928,990 A | * | 5/1990 | Rullier | 280/625 |
| RE33,388 E | * | 10/1990 | Sedlmair et al. | 280/625 |
| 5,092,622 A | * | 3/1992 | Wladar et al. | 280/636 |
| 5,106,115 A | * | 4/1992 | Wladar et al. | 280/636 |
| 5,114,174 A | | 5/1992 | Bogner | |
| 5,722,681 A | * | 3/1998 | Merino et al. | 280/634 |
| 5,921,573 A | | 7/1999 | Challande et al. | |
| 6,290,251 B1 | | 9/2001 | Chatillon et al. | |

FOREIGN PATENT DOCUMENTS

| | | |
|---|---|---|
| EP | 0 842 678 A1 | 5/1998 |
| FR | 2 125 782 | 9/1972 |
| FR | 2 652 508 | 4/1991 |
| FR | 2 731 161 A | 9/1996 |

OTHER PUBLICATIONS

French Preliminary Search Report in SN FR 596628.

* cited by examiner

*Primary Examiner*—Brian L. Johnson
*Assistant Examiner*—Hau Phan
(74) *Attorney, Agent, or Firm*—Bugnion S.A.; John Moetteli

(57) ABSTRACT

A support device on a ski for the front part of the sole of a ski boot is held by a releasable binding holding the front of the boot, including a support in which a support plate is slideably mounted transversely to the ski. A limiting arrangement limits the displacement of the support plate in the support and includes stops on both the support plate and the support. A transverse helical spring is engaged partially in the support plate and partially in the support and works in compression between the support and the support plate upon displacement of the support plate. A support device using a helical return spring is thereby produced in which the support plate travels substantially farther than in the prior art, while being perfectly guided and held in the support.

10 Claims, 4 Drawing Sheets

SUPPORT DEVICE FOR A SKI BOOT

BACKGROUND OF THE INVENTION

The invention relates to a support device on a ski for the front part of the sole of a ski boot held by a releasable binding holding the front of the boot, including a support in which a support plate is slideably mounted transversely to the ski.

A device of this type is known from U.S. Pat. No. 6,290,251, the content of which is incorporated by reference, in the name of the applicant. In this device, the stops limiting the displacement of the support plate consist of two lateral tabs arranged diagonally on each side of the support plate and also of two projections formed on the support and which are diagonally opposed. As the tabs and the projections have to be of sufficient size in the direction of displacement of the support plate, for reasons of strength, the travel of the support plate is relatively limited. Moreover, the formation of stop tabs on the support plate has the effect of substantially reducing the width of the sides of the support plate which are engaged in the slideway formed in the support, which is detrimental to the guiding of the support plate and to its retention in the support.

An embodiment close to that referred to above is described in U.S. Pat. No. 5,921,573, the content of which is incorporated by reference.

Constructions are also known in which the return spring is a kickover spring which, at the same time, limits the displacement of the support plate. Constructions of this type are described in patent FR 2 652 508, the content of which is incorporated by reference, and in U.S. Pat. No. 5,114,174, the content of which is incorporated by reference.

U.S. Pat. No. 4,088,345, the content of which is incorporated by reference, describes a construction in which the support plate is returned elastically by a closed rubber loop. No provision is made for a stop limiting the displacement of the support plate. In the construction described in patent FR 2 125 782, the content of which is incorporated by reference, the support plate is equipped with a central stud on which the ends of two opposite wire springs bear. The stud is displaced in an aperture in the support, the ends of which form a travel-limiting stop.

SUMMARY OF THE INVENTION

A support device on a ski for the front part of the sole of a ski boot is held by a releasable binding holding the front of the boot, including a support in which a support plate is slideably mounted transversely to the ski. A limiting arrangement limits the displacement of the support plate in the support and includes stops on both the support plate and the support. A transverse helical spring is engaged partially in the support plate and partially in the support and works in compression between the support and the support plate upon displacement of the support plate.

The object of the present invention is to produce a support device using a helical return spring in which the support plate travels substantially farther than in the prior art, while being perfectly guided and held in the support.

The support device according to the invention is defined in that the stops of the support and the stops of the support plate coincide in pairs at rest in a plane perpendicular to the direction of displacement of the support plate and in that the limiting arrangement which limits the displacement of the support plate includes an auxiliary piece arranged between the stops of the support and between the stops of the support plate, free in a transverse housing formed between the support and the support plate, between the stops, the size of the auxiliary piece measured in the direction of displacement of the support plate being substantially smaller than the distance between the stops such that the auxiliary piece is entrained by the support plate until it is immobilized between one of the stops of the support and one of the stops of the support plate.

If the size of the auxiliary piece is only a fraction of the distance between the stops, the support plate travels a relatively significant distance.

The housing of the auxiliary piece is formed in the central part of the support plate such that the sides of the support plate which serve to guide and to hold the support plate in the support are not involved and can carry out their function to the full.

The auxiliary piece advantageously consists of a cylindrical stud which can move in a cylindrical housing formed half in the support and half in the support plate.

The appended drawing shows, by way of example, an embodiment of the support device according to the invention.

DESCRIPTION OF THE PREFERRED EMBODIMENT

Figure 1:
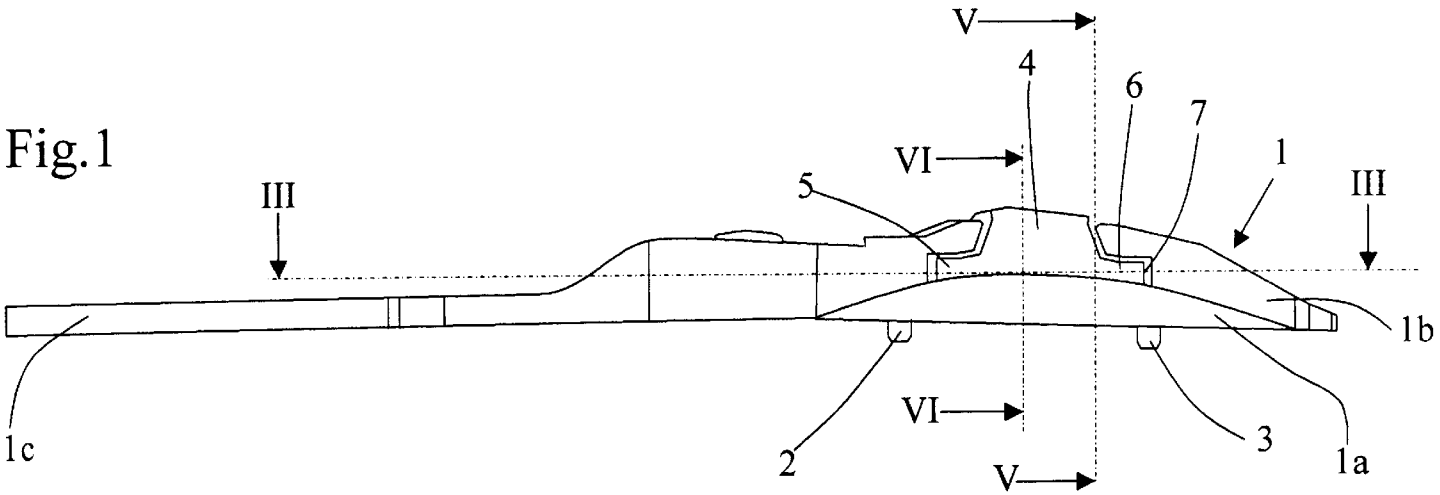
FIG. 1 shows a side view thereof.

The device shown comprises a support 1 in two parts 1*a* and 1*b*, the piece 1*a* having two feet 2 and 3 intended for engaging in a ski or in an intermediate plate for its positioning, and the piece 1*b* partially covering over the piece 1*a* having a forward extension 1*c*. The piece 1*b* is also fixed by means of screws in the ski or in the intermediate plate. The front part 1*c* is engaged under a front binding element (stop) which is not shown here but which may be seen in the drawings of patent FR 2 755 868. A support plate 4 is mounted in the support 1 and can slide transversely to the support 1. To this end, the support plate 4 is equipped with two sides 5 and 6 forming a slide guided in a slideway 7 formed in the support 1. In the part 1*a* of the support 1 is formed an approximately semicylindrical first housing 8 extending transversely to the support 1. A helical spring 9 is arranged in this housing 8. At rest, the ends of the housing 8 have two axial fingers 10 and 11 engaged in the spring 9 in order to hold the latter. An approximately semicylindrical housing 12 is also formed in the support plate 4, and is of the same length as the housing 8 and located exactly above the housing 8 so as to form a closed housing for the spring 9 (FIG. 6).

A second, housing 13 which is also approximately semicylindrical, is formed in the part la of the support 1, parallel to the housing 8, the ends of which housing 13 form stops 13*a* and 13*b*. A cylindrical stud 14 which is free to move in the housing 13 between the stops 13*a* and 13*b* is arranged in this housing 13. A second approximately semicylindrical housing 15, with the same diameter as the housing 13, is also formed in the support plate 4, between the stops 13*a* and 13*b*, the ends of which housing 15 form stops 15*a* and 15*b*. At rest, the stops 13*a* and 15*a* coincide in a plane perpendicular to the direction of displacement of the support plate 4, and the same is true of the stops 13*b* and 15*b*, such that the housings 13 and 15 together form a cylindrical housing for the stud 14 which is able to move freely in this housing, between the ends of the housing, i.e. between the stops.

Figure 2:
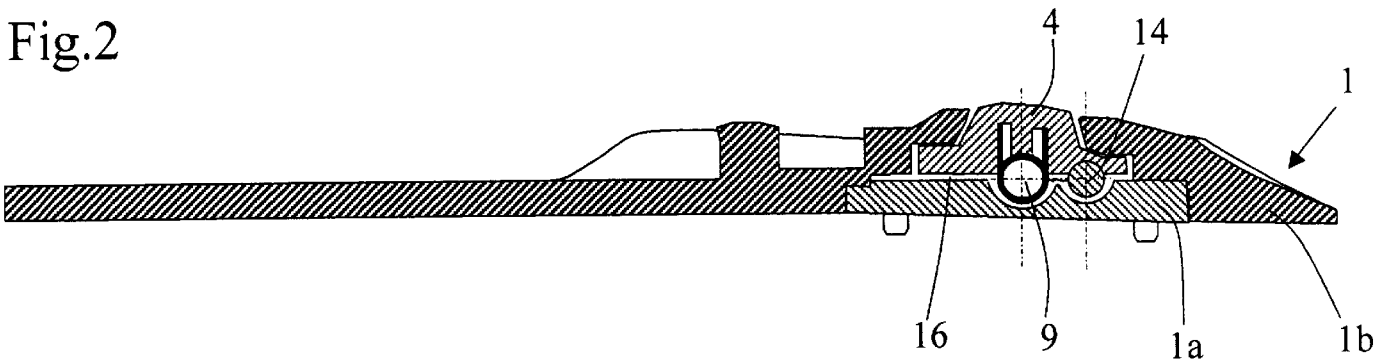
FIG. 2 is an axial sectional view along II—II of FIG. 3.
Figure 5:
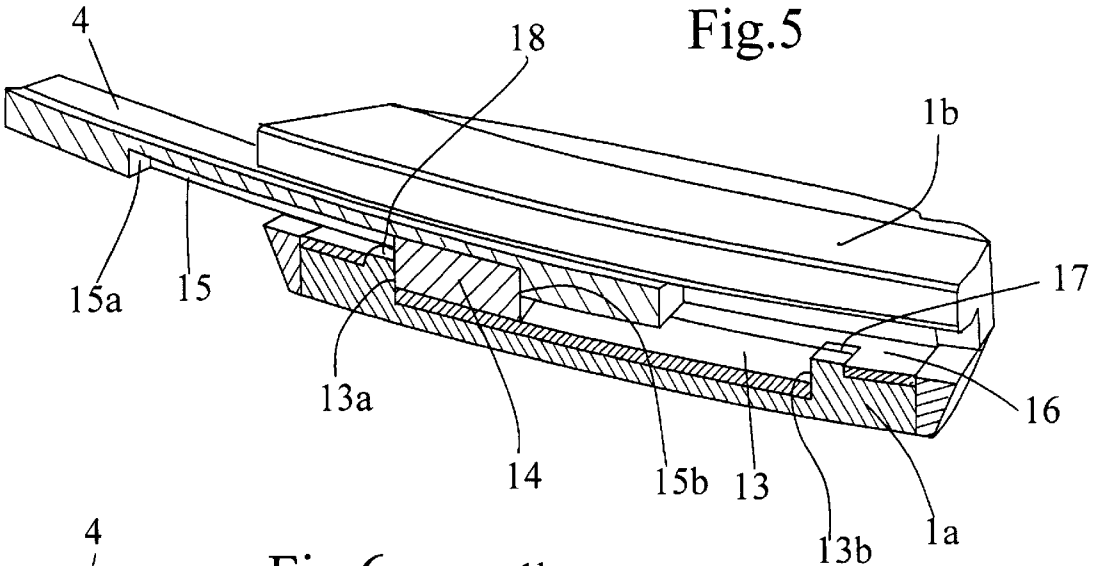
FIG. 5 is a sectional view along V—V of FIG. 1, but with the support plate in the position shown in FIG. 4.
Figure 6:
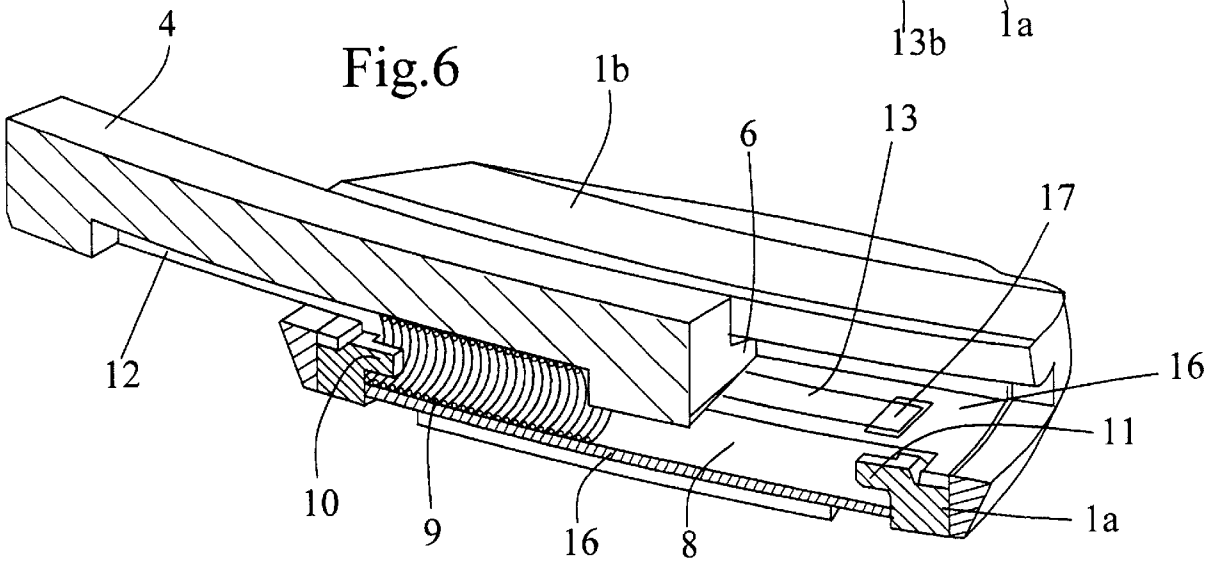
FIG. 6 is a sectional view along VI—VI of FIG. 1, with the support plate in the same position as in FIG. 5.

As may be seen in FIGS. 2, 5 and 6, the housings 8 and 13 and the part 1*a* of the support are coated with a material 16 with a low coefficient of friction, such as "TEFLON" (registered trademark), so as to reduce the friction of the stud 14 in the housing 13, of the spring 9 in the housing 8, and of the support plate 4 in the support, the displacement of the support plate consisting essentially of sliding over the material 16. The ends of the housing 13 have projections 17 and 18 of the part 1*a* of the support 1 which engage in the piece 16, as may be seen, in particular, in FIG. 6.

Figure 3:
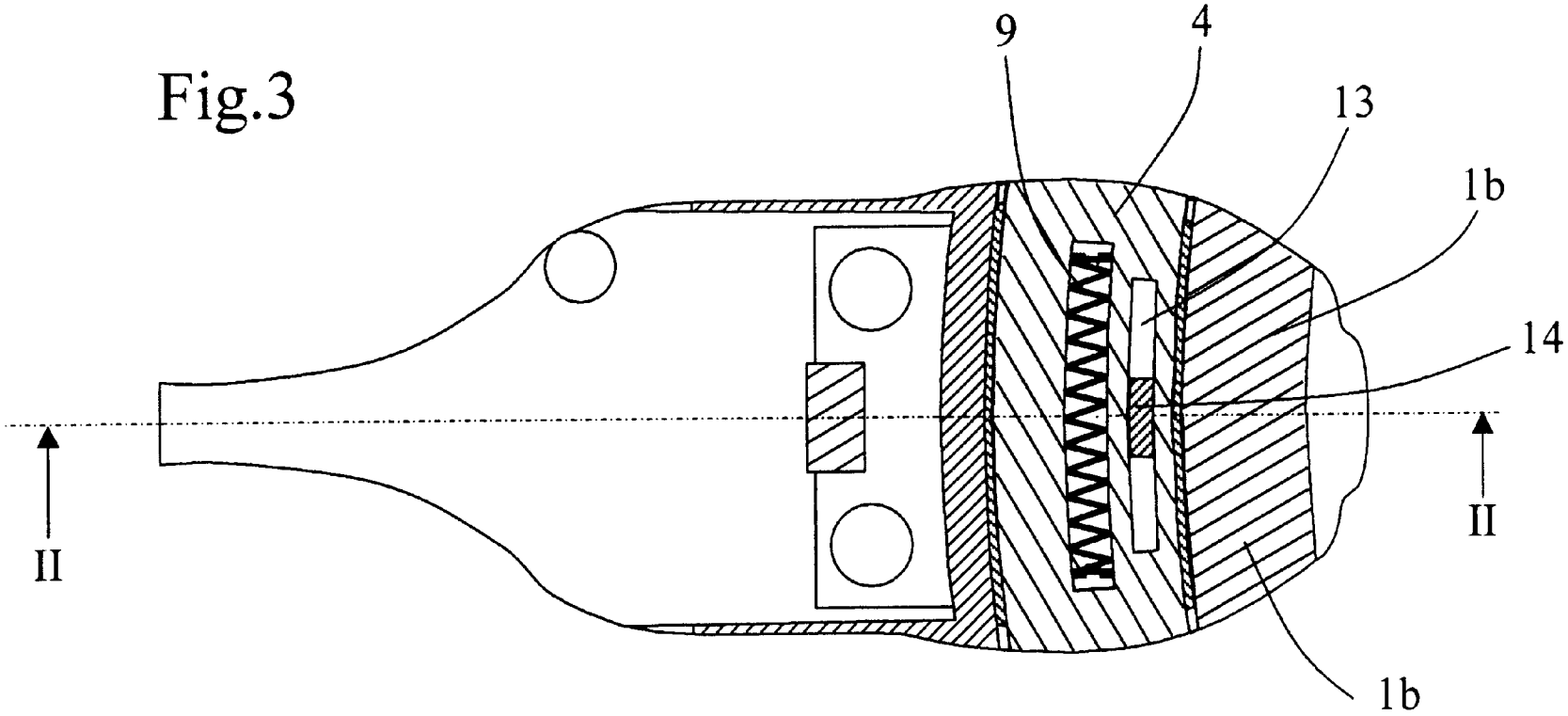
FIG. 3 is a sectional view along III—III of FIG. 1.
Figure 4:
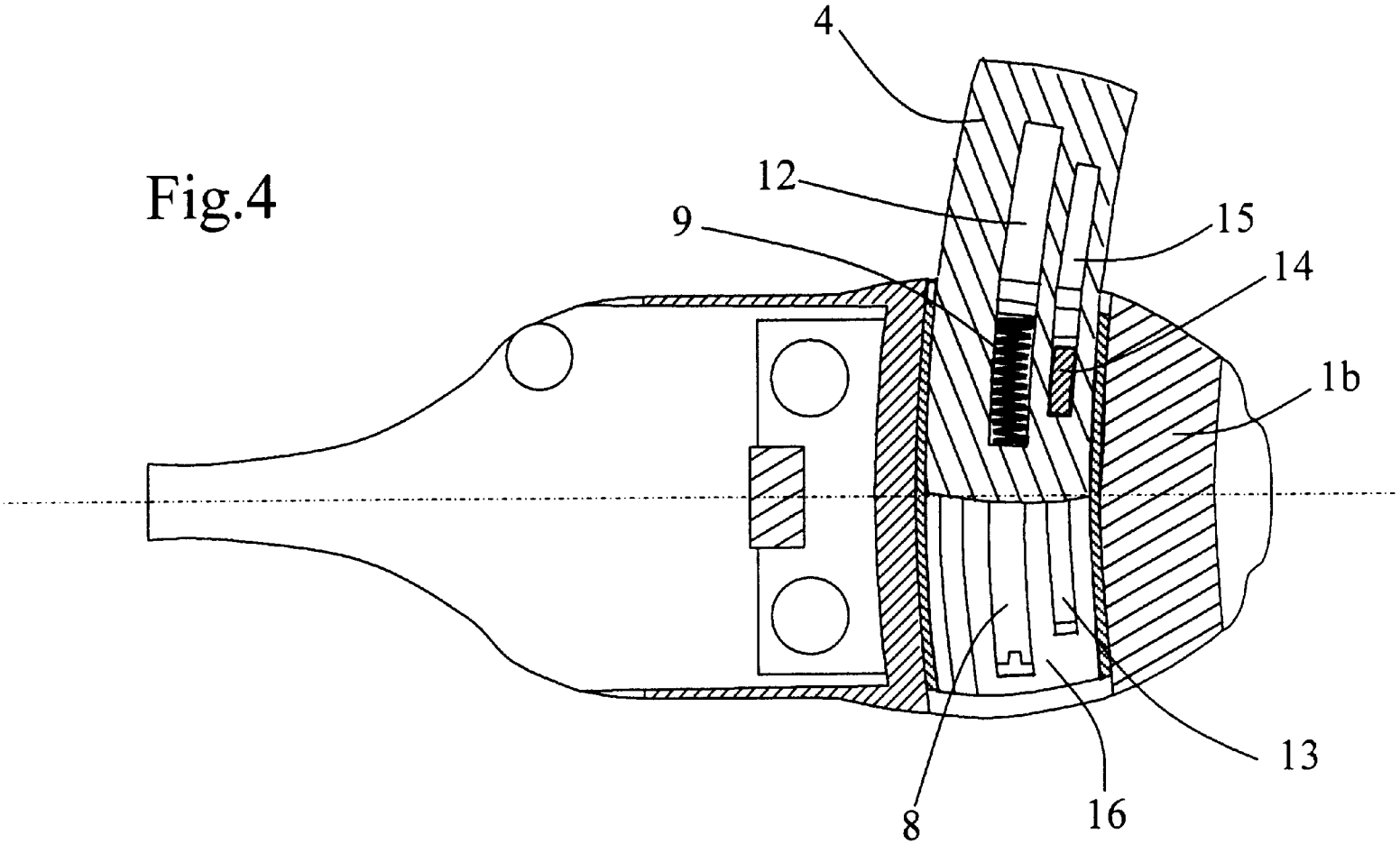
FIG. 4 is a view similar to the view shown in FIG. 3, showing the maximum displacement of the support plate in one direction.

At rest, the symmetry of forces on the spring 9 working in compression holds the support plate 4 in the position shown in FIG. 3.

When the support plate 4 is entrained by the boot, as described and shown in patent FR 2 755 868, it is displaced, in one direction or the other, until the stud 14 is immobilized between one of the ends of the housing 13 and one of the ends of the housing 15, for example between the end 13*a* and the end 15*b*, as shown in FIG. 5, i.e. between one of the stops of the support 1 and one of the stops of the support plate 4. In this position, the spring 9 is almost totally or totally compressed. As soon as the force on the support plate 4 ceases, the spring 9 returns the support plate 4 to a central position.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A support device on a ski for the front part of the sole of a ski boot held by a releasable binding holding the front of the boot, including a support in which a support plate is slideably mounted transversely to the ski, means for limiting the displacement of the support plate in the support comprising stops on the support plate and on the support, and a transverse helical spring engaged partially in the support plate and partially in the support and working in compression between the support and the support plate upon displacement of the support plate, wherein the stops of the support and the stops of the support plate pair-wise align at rest in a plane perpendicular to the direction of displacement of the support plate and wherein the means for limiting the displacement of the support plate comprises an auxiliary piece arranged between the stops of the support and the stops of the support plate, free in a transverse housing formed between the support and the support plate, between the stops, the size of the auxiliary piece measured in the direction of displacement of the support plate being substantially smaller than the distance between the stops such that the auxiliary piece is entrained by the support plate until it is immobilized between one of the stops of the support and one of the stops of the support plate.

2. The device as claimed in claim 1, wherein the size of the auxiliary piece is a fraction of the distance separating the stops.

3. The device as claimed in claim 2, wherein the auxiliary piece comprises a cylindrical stud mounted in a cylindrical housing formed half in the support and half in the support plate.

4. The device as claimed in claim 3, wherein the part of the cylindrical housing formed in the support is coated with a material with a low coefficient of friction.

5. The device as claimed in claim 4, wherein the spring is also partially housed in a housing formed in the support.

6. The device as claimed in claim 5, wherein the housing containing the spring in the support is also coated with the material with a low coefficient of friction.

7. The device as claimed in claim 1, wherein the auxiliary piece comprises a cylindrical stud mounted in a cylindrical housing formed half in the support and half in the support plate.

8. The device as claimed in claim 7, wherein the part of the cylindrical housing formed in the support is coated with a material with a low coefficient of friction.

9. The device as claimed in claim 8, wherein the spring is also partially housed in a housing formed in the support.

10. The device as claimed in claim 9, wherein the housing containing the spring in the support is also coated with the material with a low coefficient of friction.

* * * * *